US006368142B2

(12) United States Patent
Katoh et al.

(10) Patent No.: US 6,368,142 B2
(45) Date of Patent: Apr. 9, 2002

(54) INTERLAYER CONNECTION STRUCTURE

(75) Inventors: Mitsubonu Katoh; Masataka Nishijima; Toshifumi Okahira; Masashi Tsukamoto, all of Susono (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/748,380

(22) Filed: Dec. 27, 2000

(30) Foreign Application Priority Data

Dec. 27, 1999 (JP) ..... 11-371112

(51) Int. Cl.[7] ..... H01R 4/24
(52) U.S. Cl. ..... 439/402; 439/404; 439/949
(58) Field of Search ..... 439/76.2, 402, 439/404, 949

(56) References Cited

U.S. PATENT DOCUMENTS 6,220,875 B1 * 4/2001 Kawakita ..... 439/76.2
6,224,397 B1 * 5/2001 Nakamura ..... 439/76.2
6,280,253 B1 * 8/2001 Kraus et al. ..... 439/621
6,299,472 B1 * 10/2001 Beukes ..... 439/403

FOREIGN PATENT DOCUMENTS

JP 4-92309 3/1992 ..... H01B/7/00

* cited by examiner

*Primary Examiner*—Khiem Nguyen
(74) *Attorney, Agent, or Firm*—Sughrue Mion, PLLC

(57) ABSTRACT

A branch box, having an interlayer connection structure of the invention, includes insulative bus bar boards, each having a plurality of juxtaposed bus bars mounted thereon, and also having a plurality of rows of terminal holding openings each row of which are formed in the bus bar board, and are spaced at predetermined intervals along a longitudinal side edge of a respective one of the bus bars, press-connecting terminal members mounted respectively in the corresponding terminal holding openings to be electrically connected respectively to the corresponding bus bars, a plurality of wires press-connected to press-connecting end blades of the corresponding press-connecting terminal members extending through the terminal holding openings, wire-holding insulative boards on which the wires are mounted in a fixed manner, and upper and lower casings covering these component parts.

5 Claims, 9 Drawing Sheets

INTERLAYER CONNECTION STRUCTURE

BACKGROUND OF THE INVENTION

1. Field of the Invention

This invention relates to an interlayer connection structure, and more particularly to an improved interlayer connection structure in which a branch•joint connection between a bus bar layer, having a plurality of bus bars, and a wire layer, having a plurality of wires, is effected.

2. Description of the Related Art

There has been proposed a so-called interlayer connection structure used as a wiring connection structure capable of achieving a high-density branch•joint connection of the wiring in an electric connection box, such as a branch box, used in the connection of an electric system of an automobile.

In this structure, a branch•joint connection between a bus bar layer, having a plurality of bus bars, and a wire layer, having a plurality of wires, is effected through press-connecting terminal portions formed on the bus bars.

FIG. 14 shows one such conventional interlayer connection structure.

The interlayer connection structure, shown in this Figure, is disclosed in JP-A-4-92309 directed to a flat wire harness-producing method, and this structure comprises a bus bar board 1 of an insulative material, having a plurality of juxtaposed slits 1*a* formed therein, a plurality of junction bars (bus bars) 3*a*, 3*b*, 3*c*, 3*d* and 3*e* press-fitted in the slits 1*a* to form a bus bar layer, and a plurality of wires 5, which forms a wire layer, and are laid on the bus bar layer.

Each of the junction bars 3*a*, 3*b*, 3*c*, 3*d* and 3*e* has tab terminals (connector terminals) T1, formed respectively at opposite ends thereof, and also has press-connecting terminal portions 14 formed on one longitudinal side edge thereof, the press-connecting terminal portion 14 having press-connecting end blades 14*a* for press-connection to the wire 5. In this illustrated example, each tab terminal T1 is connected to a male terminal (not shown), received in a connector 17, 18, through a relay terminal 16 of a female-female type.

The wires 5 are so-called sheathed (or covered) wires, and are arranged on the bus bar board 1 at predetermined intervals, and extend in a direction perpendicular to the direction of extending of the junction bars 3*a*, 3*b*, 3*c*, 3*d* and 3*e*. These wires 5 are press-connected to the predetermined press-connecting terminal portions 14 of the junction bars 3*a*, 3*b*, 3*c*, 3*d* and 3*e*, respectively. A cover 19, having press-connecting blade relief holes 21 formed therethrough for preventing the interference thereof with the press-connecting end blades 14*a*, is put on the bus bar board 1, thus effecting the desired branch•joint connection.

In the above conventional interlayer connection structure, the press-connecting terminal portions 14 are formed integrally on the junction bars 3*a*, 3*b*, 3*c*, 3*d* and 3*e*, and the positions of formation of the projected press-connecting terminal portions 14 are determined for each junction bar 3*a*, 3*b*, 3*c*, 3*d*, 3*e*, depending on the positions of the associated wires to be connected respectively to these terminal portions 14.

Therefore, in order to achieve a wide variety of branch•joint connections for the plurality of wires 5, many kinds of junction bars 3*a*, 3*b*, 3*c*, 3*d* and 3*e*, having the press-connecting terminal portions 14 projecting from different positions, must be prepared as shown in the drawings. Therefore, the number of kinds of bus bars, used to form the bus bar layer, increases, and the number of the component parts increases, and this has invited a problem that the production cost increases.

SUMMARY OF THE INVENTION

It is an object of this invention to overcome the above problems, and more specifically to provide an interlayer connection structure in which a wide variety of branch•joint connections can be achieved without increasing kinds of bus bars used to form a bus bar layer.

The above object of the invention has been achieved by an interlayer connection structure comprising:

an insulative bus bar board having a plurality of juxtaposed bus bars of an electrically-conductive material mounted thereon, the bus bar board having a plurality of rows of terminal holding openings each row of which are formed in the bus bar board, and are spaced at predetermined intervals along a longitudinal side edge of a respective one of the bus bars;

press-connecting terminal members mounted respectively in the corresponding terminal holding openings to be electrically connected respectively to the corresponding bus bars; and a plurality of wires press-connected to press-connecting end blades of the corresponding press-connecting terminal members extending through the terminal holding openings;

wherein a branch•joint connection between a bus bar layer, formed by the plurality of bus bars, and a wire layer, formed by the plurality of wires, is effected through the press-connecting terminal members.

In the above construction, the positions of mounting of the press-connecting terminal members on each bus bar can be easily changed arbitrarily by selectively changing the terminal holding openings in which the press-connecting terminal members are to be mounted, respectively. And, a variety of bus bar layers, having different mounting positions of the press-connecting terminal members, can be provided even by the use of a single kind of bus bars.

Therefore, there can be obtained the interlayer connection structure in which a wide variety of branch•joint connections can be effected without increasing the kind of the bus bars used to form the bus bar layer. By thus reducing the kind of the bus bars to be used, the production cost can be reduced.

In the above interlayer connection structure, preferably, there is provided a wire-holding insulative board which has a plurality of wire-mounting grooves, in which the wires can be mounted in a fixed manner, respectively, and press-connecting blade relief holes for enabling the press-connecting end blades to be press-connected to the wires held in the wire-mounting grooves, and the wires are mounted on the wire-holding insulative board mated with the insulative bus bar board.

With this construction, the wire layer and the bus bar layer are formed on the separate insulative boards, respectively, and therefore the wire layer-forming operation and the bus bar layer-forming operation can be effected concurrently, and the time, required for the operation, can be reduced. The bus bar layer and the wire layer, thus formed respectively on the two insulative boards, are superposed together, and by doing so, the desired interlayer connection can be easily completed, and the efficiency of the operation can be enhanced.

Preferably, the plurality of bus bars are mounted on an obverse surface of the insulative bus bar board, and a plurality of wire-mounting grooves, in which the wires can be mounted in a fixed manner, respectively, are formed in a reverse surface of the insulative bus bar board.

With this construction, only one insulative board is required for effecting the interlayer connection between the pair of bus bar layer and wire layer, and therefore the thickness in the direction of stacking of the layers can be reduced. Therefore, the number of the component parts, used in the interlayer connection, is reduced, so that the cost can be reduced, and besides an electric connection box, using the interlayer connection, can be formed into a small size.

Preferably, contact portions, which face the press-connecting terminal members, are formed by bending respectively on those portions of at least one longitudinal side edge of the bus bar corresponding respectively to the terminal holding openings, and each of the press-connecting terminal members has a resilient contact piece portion for press-contact with the contact portion.

With this construction, each of the juxtaposed bus bars, mounted on the insulative bus bar board, can be electrically connected to the press-connecting terminal member through the resilient contact of the resilient contact piece portion of the press-connecting terminal member with the contact portion. Therefore, by suitably determining the amount of resilient deformation of the resilient contact piece portion and an elastic coefficient thereof, the good electrical connection can be obtained regardless of dimensional tolerances, developing between each of the juxtaposed bus bars, mounted on the insulative bus bar board, and the terminal holding openings. Therefore, the dimensional tolerances of the component parts can be made less strict, and therefore the production cost is reduced, so that the productivity can be enhanced.

Preferably, the terminal holding openings are formed in a staggered manner along the opposite longitudinal side edges of each of the bus bars.

With this construction, the interval between the adjacent terminal holding openings can be reduced to a half of the interval of the adjacent terminal holding openings in the interlayer connection structure in which the plurality of terminal holding openings spaced at the predetermined intervals only along one longitudinal side edge of the bus bar. Therefore, the pitch of the wires, forming the wire layer, can be reduced, and by doing so, the interlayer connection of a higher density can be achieved, and also the electric connection box, having the interlayer connection, can be formed into a small size.

DETAILED DESCRIPTION OF THE PREFERRED EMBODIMENTS

One preferred embodiment of an interlayer connection structure of the present invention will now be described in detail with reference to the accompanying drawings.

Figure 1:
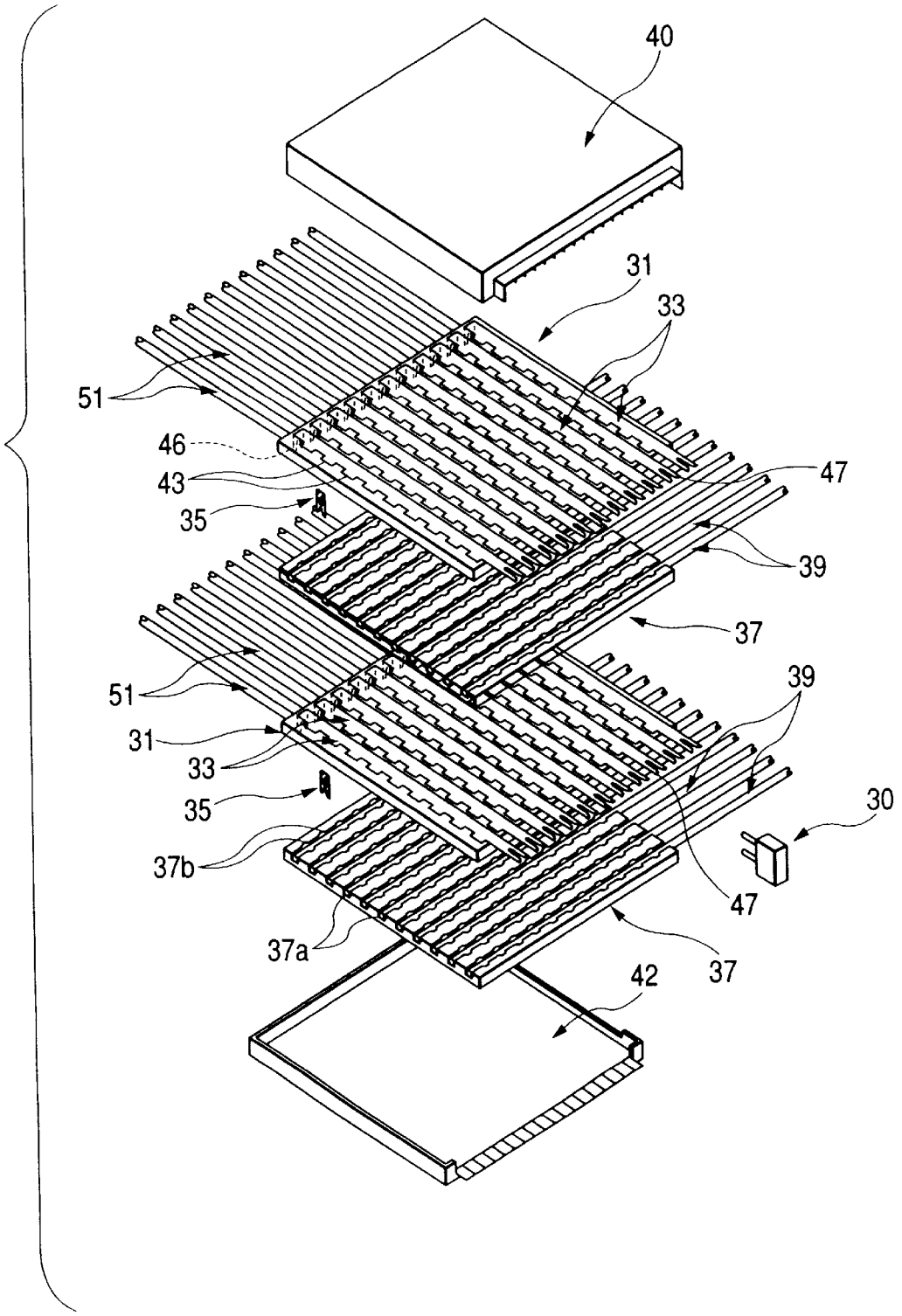
FIG. 1 is an exploded, perspective view of a branch box having a first embodiment of an interlayer connection structure of the invention.
Figure 2:
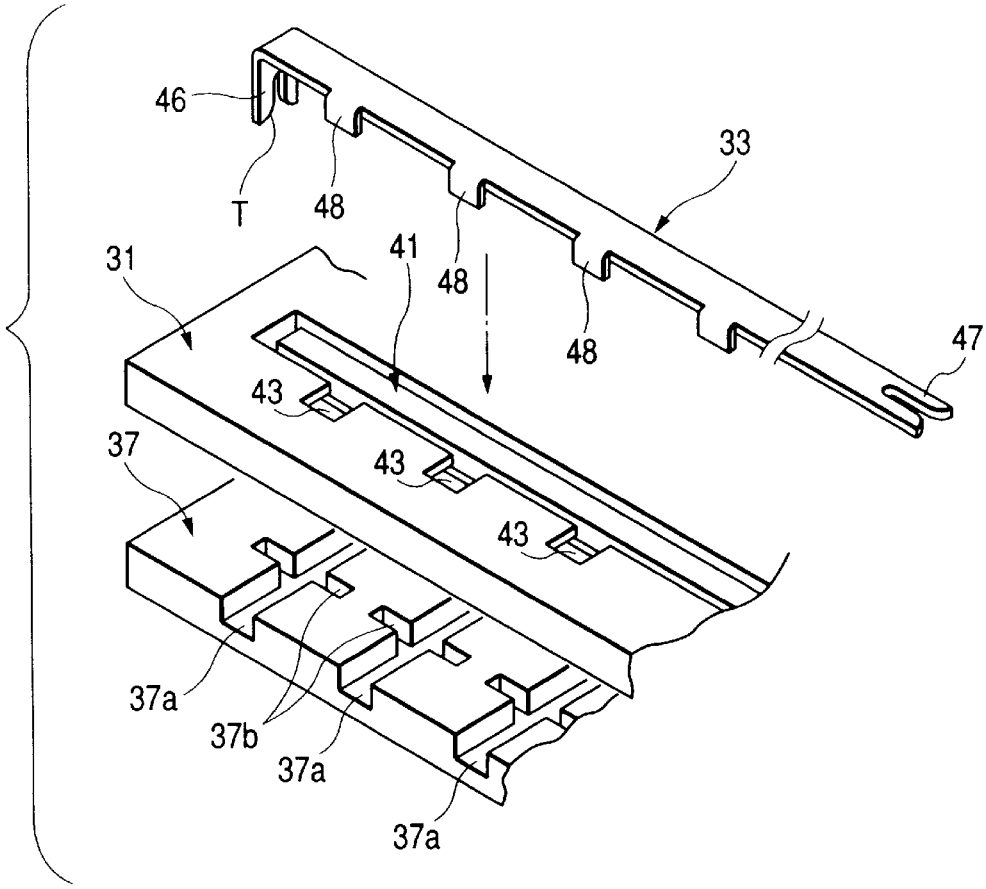
FIG. 2 is an enlarged perspective view of an important portion, showing an insulative bus bar board and a bus bar shown in FIG. 1.
Figure 3:
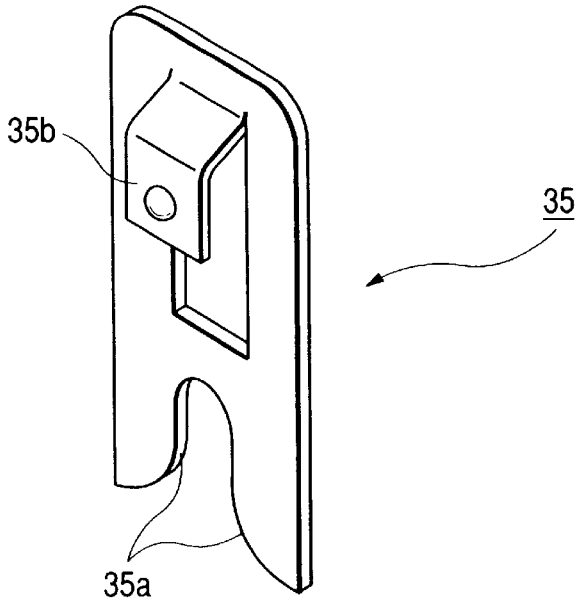
FIG. 3 is an enlarged perspective view showing a press-connecting terminal member shown in FIG. 1.
Figure 4:
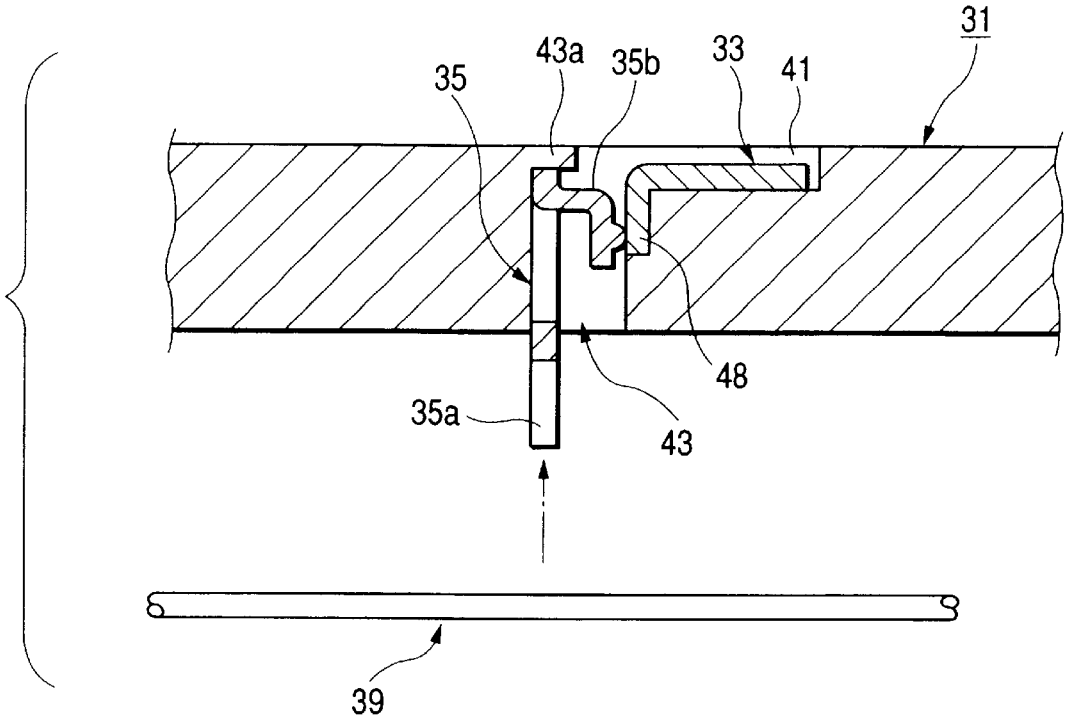
FIG. 4 is an enlarged cross-sectional view of an important portion, showing the interlayer connection structure of FIG. 1 in its assembled condition.
Figure 5:
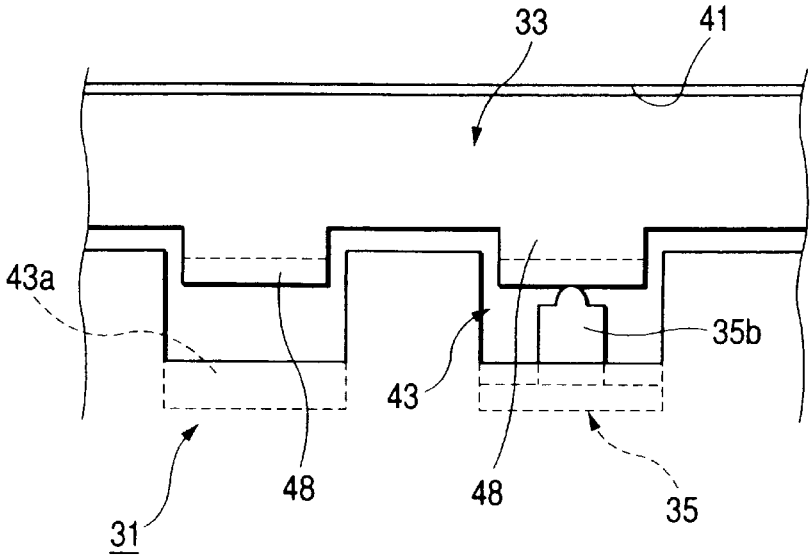
FIG. 5 is a top plan view of the interlayer connection structure shown in FIG. 4.

FIG. 1 is an exploded, perspective view of a branch box having the first embodiment of the interlayer connection structure of the invention, FIG. 2 is an enlarged perspective view of an important portion, showing an insulative bus bar board and a bus bar shown in FIG. 1, FIG. 3 is an enlarged perspective view showing a press-connecting terminal member shown in FIG. 1, FIG. 4 is an enlarged cross-sectional view of an important portion, showing the interlayer connection structure of FIG. 1 in its assembled condition, and FIG. 5 is a top plan view of the interlayer connection structure shown in FIG. 4.

The branch box (electric connection box), having the first embodiment of the interlayer connection structure of the invention, is used in a branch•joint connection of an electric system of an automobile or the like. This branch box comprises insulative bus bar boards 31, each having a plurality of juxtaposed bus bars 33 mounted thereon, and also having a plurality of rows of terminal holding openings 43 each row of which are formed in the bus bar board, and are spaced at predetermined intervals along one longitudinal side edge of a respective one of the bus bars 33, press-connecting terminal members 35 mounted respectively in the corresponding terminal holding openings 43 to be electrically connected respectively to the corresponding bus bars 33, a plurality of wires 39 press-connected to press-connecting end blades 35*a* of the corresponding press-connecting terminal members 35 extending through the terminal holding openings 43, wire-holding insulative boards 37 on which the wires 39 are mounted in a fixed manner, and upper and lower casings 40 and 42 covering these component parts. As shown in FIGS. 2 and 4, the insulative bus bar board 31 includes a plurality of rows of bus bar mounting portions 41 (each in the form of a recess) each for receiving the bus bar 33 in a fitted manner, and the row of terminal holding opennings 43 which are formed in one side edge of each of the bus bar mounting portions 41, and are spaced at the predetermined intervals therealong.

The bus bar 33 is formed by pressing an electrically-conductive metal sheet into a predetermined shape. As shown in FIG. 2, a press-connecting terminal portion 46 and a tuning fork terminal portion 47 are formed at opposite ends of the bus bar 33, respectively. Further, contact portions 48, which face the press-connecting terminal members 35 mounted in the terminal holding openings 43, are formed on one longitudinal side edge of the bus bar 33, and are arranged at the same pitch as that of the terminal holding openings 43, the contact portions 48 being bent perpendicularly relative to the bus bar 33.

The press-connecting terminal portion 46, formed by perpendicularly bending one end portion of the bus bar 33, has press-connecting end blades T which cut an insulating sheath of a wire and hold a conductor of the wire therebetween. The wires 51, introduced into one end portion of the bus bar board 31 in the direction of the length of the bus bars 33, are press-connected respectively to the press-connecting terminal portions 46 of the bus bars 33. A terminal of a fuse 30 is fixedly held in the tuning fork terminal portion 47.

The press-connecting terminal member 35 is formed by pressing an electrically-conductive metal sheet into a predetermined shape. As shown in FIG. 3, this terminal member 35 includes the pair of press-connecting end blades 35*a*, capable of being press-connected to the wire 39, and a resilient contact piece portion 35*b* which is pressed against the contact portion 48 of the bus bar 33 when the terminal member 35 is mounted in the terminal holding opening 43 in the insulative bus bar board 31. The resilient contact piece portion 35*b* can be formed by stamping in the above pressing operation.

As shown in FIGS. 4 and 5, the press-connecting terminal member 35 is press-fitted into the terminal holding opening 43 from the reverse side (lower side in FIG. 4) of the insulative bus bar board 31. When the amount of insertion of the press-connecting terminal member 35 into the terminal holding opening 43 reaches a predetermined value, the terminal member 35 is held in the terminal holding opening 43 in such a manner that an upper end of this terminal member 35 is held against a step portion 43*a,* formed at an upper portion of the terminal holding opening 43, while the press-connecting end blades 35*a*, formed at the lower end of the terminal member 35, project outwardly from the reverse side of the insulative bus bar board 31.

In this condition, the resilient contact piece portion 35*b* of the press-connecting terminal member 35 resiliently contacts the contact portion 48 of the bus bar 33 with a predetermined contact pressure. Therefore, by suitably determining the amount of resilient deformation of the resilient contact piece portion 35*b* and an elastic coefficient thereof, the good electrical connection between the resilient contact piece portion 35*b* and the contact portion 48 can be obtained regardless of dimensional tolerances, developing between each of the juxtaposed bus bars 33, mounted on the insulative bus bar board 31, and the terminal holding openings 43.

Therefore, the dimensional tolerances of the component parts, including the insulative bus bar boards 31, the bus bars 33 and the press-connecting terminal members 35, can be made less strict, and therefore the production cost is reduced, so that the productivity can be enhanced.

On said wire-holding insulative board 37, as shown in FIGS. 1 and 2, wire-mounting grooves 37*a* are formed on the side with which the reverse side of the insulative bus bar board 31 is mated, and the wires 39 are held respectively in these wire-mounting grooves 37*a* in a predetermined pattern to form a wire layer. Also, press-connecting blade relief holes 37*b* for enabling the press-connecting end blades 35*a* to be press-connected to the wires 39, held in the wire-mounting grooves 37*a,* are formed in said that side of the wire-holding insulative board 37.

When the wire-holding insulative board 37, having the wires 39 held in the respective wire-mounting grooves 37*a,* is mated with the reverse side of the insulative bus bar board 31, the press-connecting end blades 35*a* of each of the press-connecting terminal members 35, held on the insulative bus bar board 31, are inserted into the press-connecting blade relief holes 37*b,* and cut an insulating sheath of the wire 39, so that the press-connecting terminal member 35 is press-connected to a conductor of the wire 39. Therefore, the bus bar 33 and the wire 39 are electrically connected together through the press-connecting terminal member 35.

The branch box of this embodiment comprises two sets of interlayer connection structures, that is, two pairs of wire-holding insulative boards 37 and insulative bus bar boards 31 which are stacked together. Each fuse 30 is connected between the tuning fork terminal portions 47 of the corresponding upper and lower bus bars 33 and 33. An electric connection box, comprising one or more than two sets of interlayer connection structures, can be provided.

In the interlayer connection structure of the branch box of this embodiment, the mounting positions of the press-connecting terminal members 35 on each bus bar 33 can be easily changed arbitrarily by selectively changing the terminal holding openings 43 in which the press-connecting terminal members 35 are to be mounted, respectively. Thus, a variety of bus bar layers, having different mounting positions of the press-connecting terminal members 35, can be provided even by the use of a single kind of bus bars 33.

Therefore, there can be obtained the interlayer connection structure in which a wide variety of branch•joint connections can be effected without increasing the kind of the bus bars 33 used to form the bus bar layer. By thus reducing the kind of the bus bars 33 to be used, the production cost can be reduced as compared with the conventional interlayer connection structure employing several kinds of bus bars.

In the interlayer connection structure of this first embodiment, the wire layer, having the juxtaposed wires 39, and the bus bar layer, having the juxtaposed bus bars 33, are formed on the separate insulative boards 37 and 31, respectively, and therefore the wire layer-forming operation and the bus bar layer-forming operation can be effected concurrently, and the time, required for the operation, can be reduced.

The bus bar layer and the wire layer, thus formed respectively on the insulative boards 31 and 37, are superposed together, and by doing so, the desired interlayer connection can be easily completed, and the efficiency of the operation can be enhanced.

The bus bars, the insulative bus bar board, the press-connecting terminal members and so on to be used in the interlayer connection structure of the invention are not limited to those used in the above embodiment, and various modifications of these parts can be made.

Figure 6:
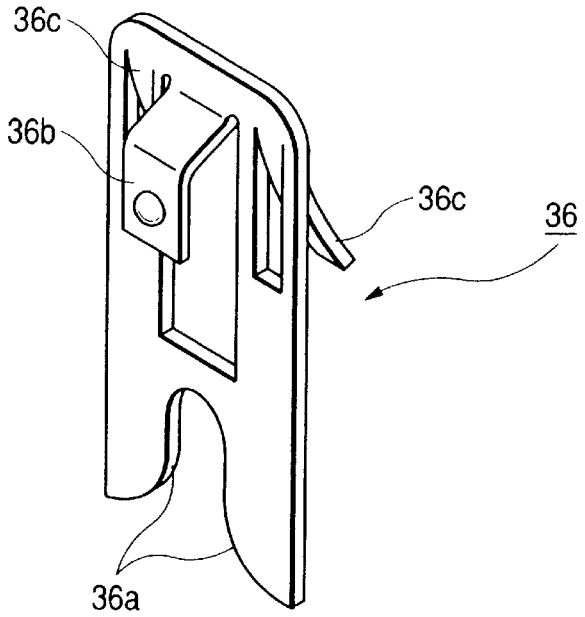
FIG. 6 is an enlarged perspective view of a modified press-connecting terminal member of the invention.
Figure 7:
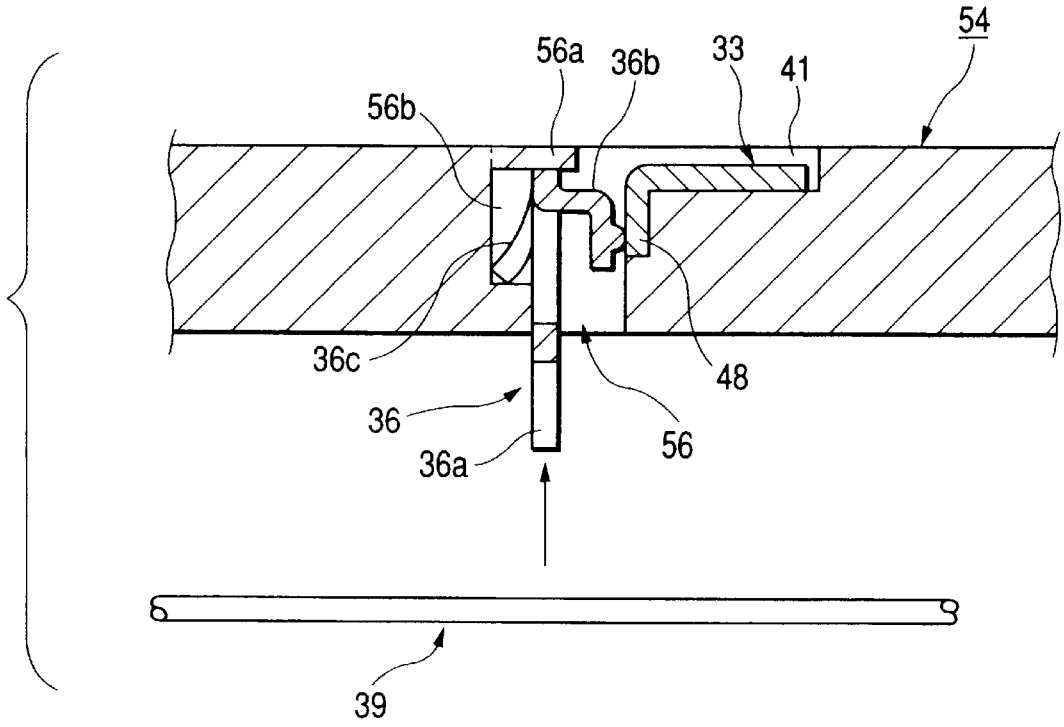
FIG. 7 is an enlarged cross-sectional view of an important portion, showing the press-connecting terminal member of FIG. 6 in its mounted condition.

For example, a press-connecting terminal member 36, shown in FIGS. 6 and 7, is formed by pressing an electrically-conductive metal sheet into a predetermined shape, and this terminal member 36 includes a pair of press-connecting end blades 36*a,* capable of being press-connected to the wire 39, a resilient contact piece portion 36*b,* which is pressed against the contact portion 48 of the bus bar 33 when the terminal member 36 is mounted in a terminal holding opening 56 in an insulative bus bar board 54, and a pair of retaining piece portions 36*c* for preventing the terminal member 36 from being disengaged from the terminal holding opening 56. The resilient contact piece portion 36*b* and the retaining piece portions 36*c* are formed by stamping and bending the relevant portions away from each other in the above pressing operation.

The press-connecting terminal member 36 is inserted into the terminal holding opening 56 from the reverse side (lower side in FIG. 7) of the insulative bus bar board 54. When the amount of insertion of the press-connecting terminal member 36 into the terminal holding opening 56 reaches a predetermined value, the terminal member 36 is held in the terminal holding opening 56. In this condition, an upper end of this terminal member 36 is held against a step portion 56*a,* formed at an upper portion of the terminal holding opening 56, and the retaining piece portions 36*c* are engaged in an engagement recess 56*b* formed in the inner surface of the terminal holding opening 56, and the press-connecting end blades 36*a,* formed at the lower end of the terminal member 36, project outwardly from the reverse side of the insulative bus bar board 54.

Thus, the press-connecting terminal member 36 is positively held in the terminal holding opening 56, and will not be accidentally disengaged from the insulative bus bar board 54 during the assembling operation.

Next, a second embodiment of an interlayer connection structure of the invention will be described with reference to FIGS. 8 to 12.

Figure 8:
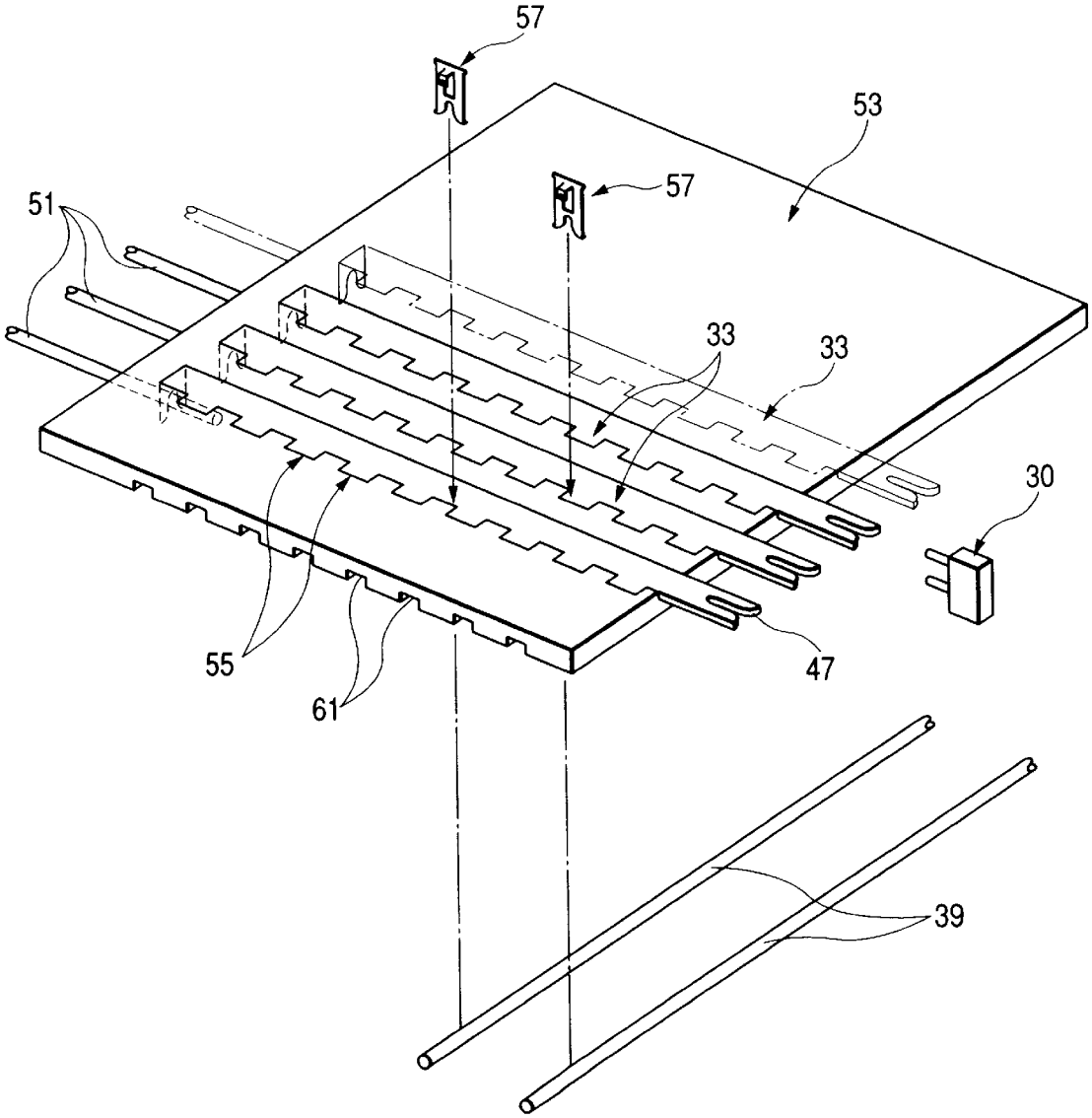
FIG. 8 is an enlarged perspective view showing an important portion of a second embodiment of an interlayer connection structure of the invention.
Figure 9:
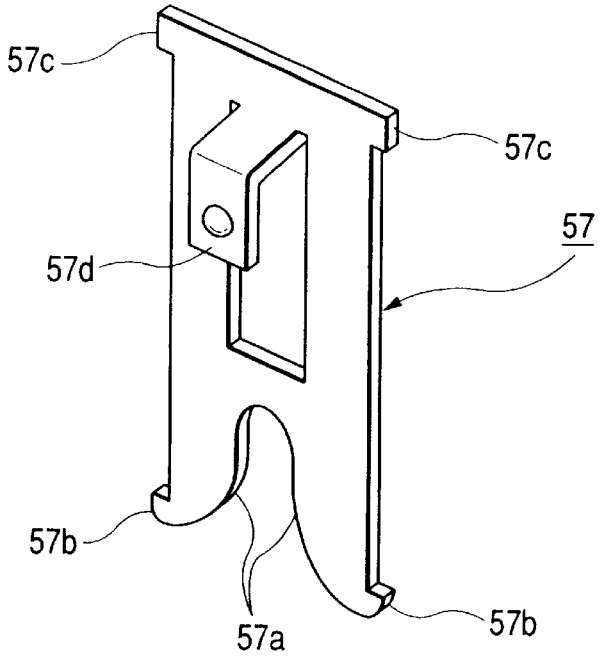
FIG. 9 is an enlarged perspective view of a press-connecting terminal member shown in FIG. 8.
Figure 10:
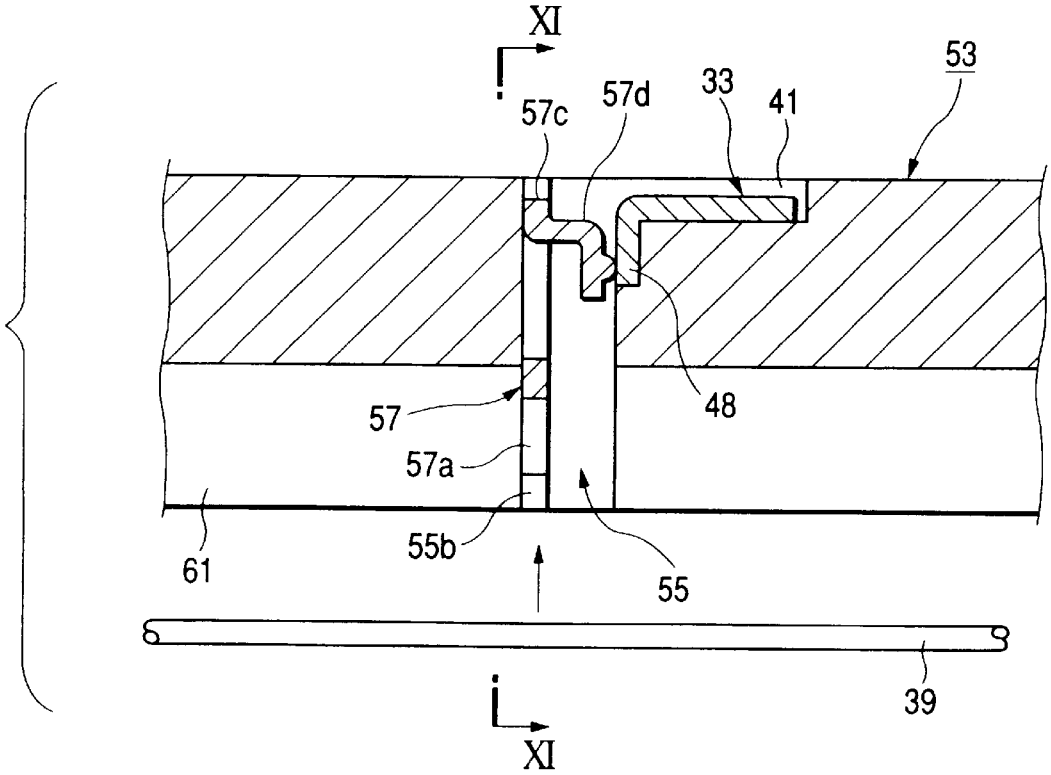
FIG. 10 is an enlarged cross-sectional view of an important portion, showing the interlayer connection structure of FIG. 8 in its assembled condition.
Figure 11:
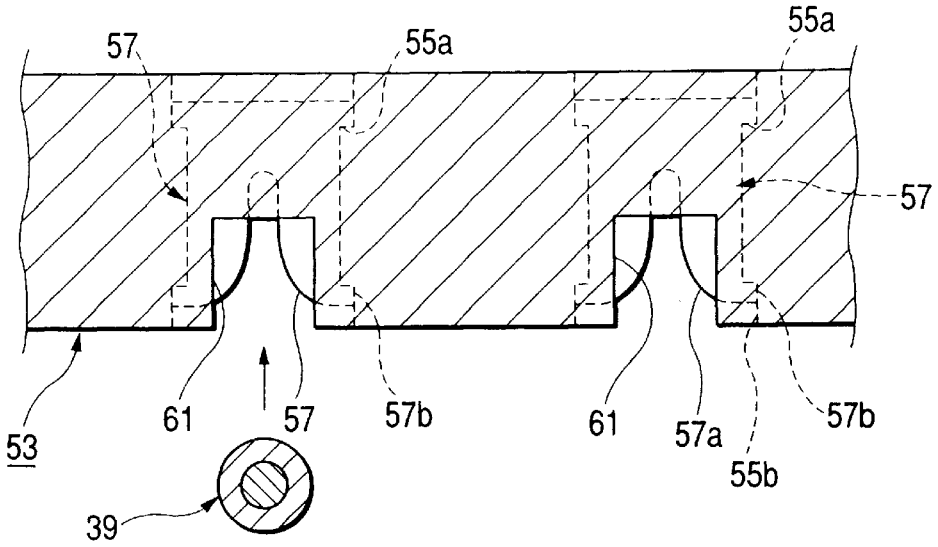
FIG. 11 is a cross-sectional view taken along the line XI—XI of FIG. 10.
Figure 12:
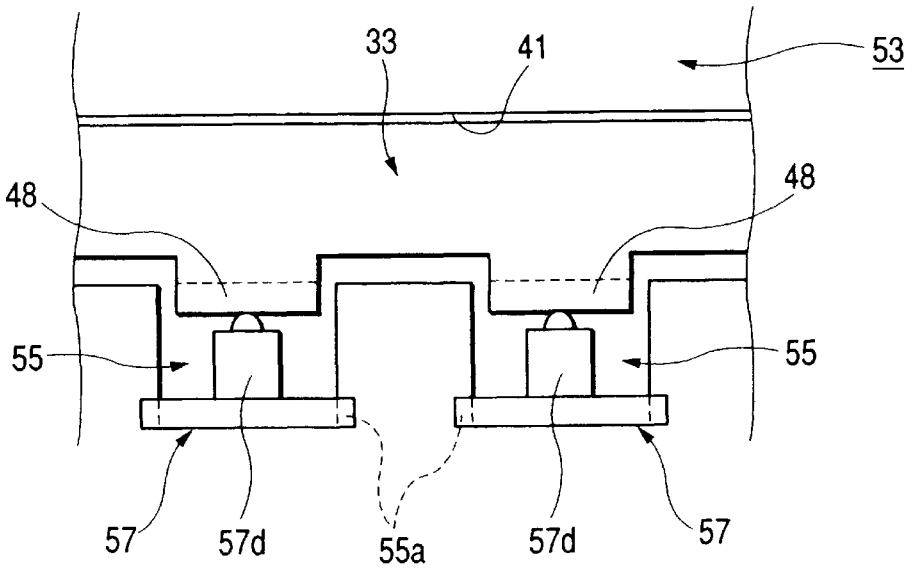
FIG. 12 is a top plan view of the interlayer connection structure shown in FIG. 10.

FIG. 8 is an enlarged perspective view of an important portion of the second embodiment of the interlayer connection structure of the invention, FIG. 9 is an enlarged perspective view of a press-connecting terminal member shown in FIG. 8, FIG. 10 is an enlarged cross-sectional view of an important portion of the interlayer connection structure of FIG. 8 in its assembled condition, FIG. 11 is a cross-sectional view taken along the line XI—XI of FIG. 10, and FIG. 12 is a top plan view of the interlayer connection structure shown in FIG. 10.

In the interlayer connection structure of this second embodiment, the use of the wire-holding insulative board 37, described above for the first embodiment, is omitted, and the press-connecting terminal members 57 can be mounted on an insulative bus bar board 53 by inserting these terminal members 57 from an obverse side (upper side in FIG. 8) of the insulative bus bar board 53, as shown in FIG. 8.

The insulative bus bar board 53 is generally similar in basic construction to the insulative bus bar board 31 of the first embodiment in that the bus bar board 53 includes a plurality of rows of bus bar mounting portions 41 (each in the form of a recess) each for receiving a bus bar 33 in a fitted manner, and a rows of terminal holding openings 55 which are formed in one side edge of each of the bus bar mounting portions 41, and are spaced at predetermined intervals therealong.

As shown in FIGS. 10 and 11, a plurality of wire-mounting grooves 61, in which wires 39 can be mounted, respectively, are formed in the reverse surface of the insulative bus bar board 53, while the plurality of bus bars 33 are mounted on the obverse surface of this insulative bus bar board 53.

As shown in FIG. 9, the retaining projections 57*b* (for withdrawal prevention purposes) are formed respectively at outer edges of press-connecting end blades 57*a* formed at a lower end of the terminal member 57. Positioning projections 57*c* are formed respectively on the opposite side edges of the terminal member 57 at an upper end thereof. In this embodiment, also, the press-connecting terminal member 57 is formed by pressing a metal sheet into a predetermined shape, and is similar to the press-connecting terminal member 35 of the first embodiment in that a resilient contact piece portion 57*d* for resilient contact with a contact portion 48 of the bus bar 33 is formed by stamping in the above pressing operation.

The press-connecting terminal member 57 is inserted into the terminal holding opening 55 from the obverse side (upper side in FIG. 10) of the insulative bus bar board 53. When the terminal member 57 is inserted into the terminal holding opening 55, the distal end portions of the pair of press-connecting end blades 57*a* and 57*a,* formed at the lower end of the terminal member 57, are resiliently bent toward each other such that the width or dimension, extending between the outer edges of the distal end portions, is made generally equal to a width of an inner portion of the terminal holding opening 55, and in this condition the press-connecting terminal member 57 is inserted into the terminal holding opening 55.

Then, when the amount of insertion of the press-connecting terminal member 57 into the terminal holding opening 55 reaches the predetermined value, as shown in FIGS. 10 to 12, the positioning projections 57*c* abut respectively against step portions 55*a* formed at an upper portion of the terminal holding opening 55, then the retaining projections 57*b* are moved away from each other and engaged respectively with larger-width portions 55*b* formed at a lower end of the terminal holding opening 55. Further press-connecting end blades 57*a* formed at the lower end of the terminal member 57 project into the wire-mounting groove 61 formed in the reverses surface of the insulative bus bar board 53. Consequently, this terminal member 57 is held in the terminal holding opening 55.

Namely, the press-connecting terminal member 57 is positively held in the terminal holding opening 55 against withdrawal, and will not be accidentally disengaged from the insulative bus bar board 53 during the assembling operation.

Therefore, in the interlayer connection structure of this second embodiment, the effects of the interlayer connection structure of the first embodiment are obtained, and besides since a wire layer, having the juxtaposed wires 39, and a bus bar layer, having the juxtaposed bus bars 33, are formed on the single insulative bus bar board 53, only one insulative board is required for this layer-to-layer connection, and therefore the thickness in the direction of stacking of the layers can be reduced.

Therefore, the number of the component parts, used in the interlayer connection, is reduced, so that the cost can be reduced, and besides an electric connection box, such as a branch box, using the interlayer connection, can be formed into a small size.

Figure 13:
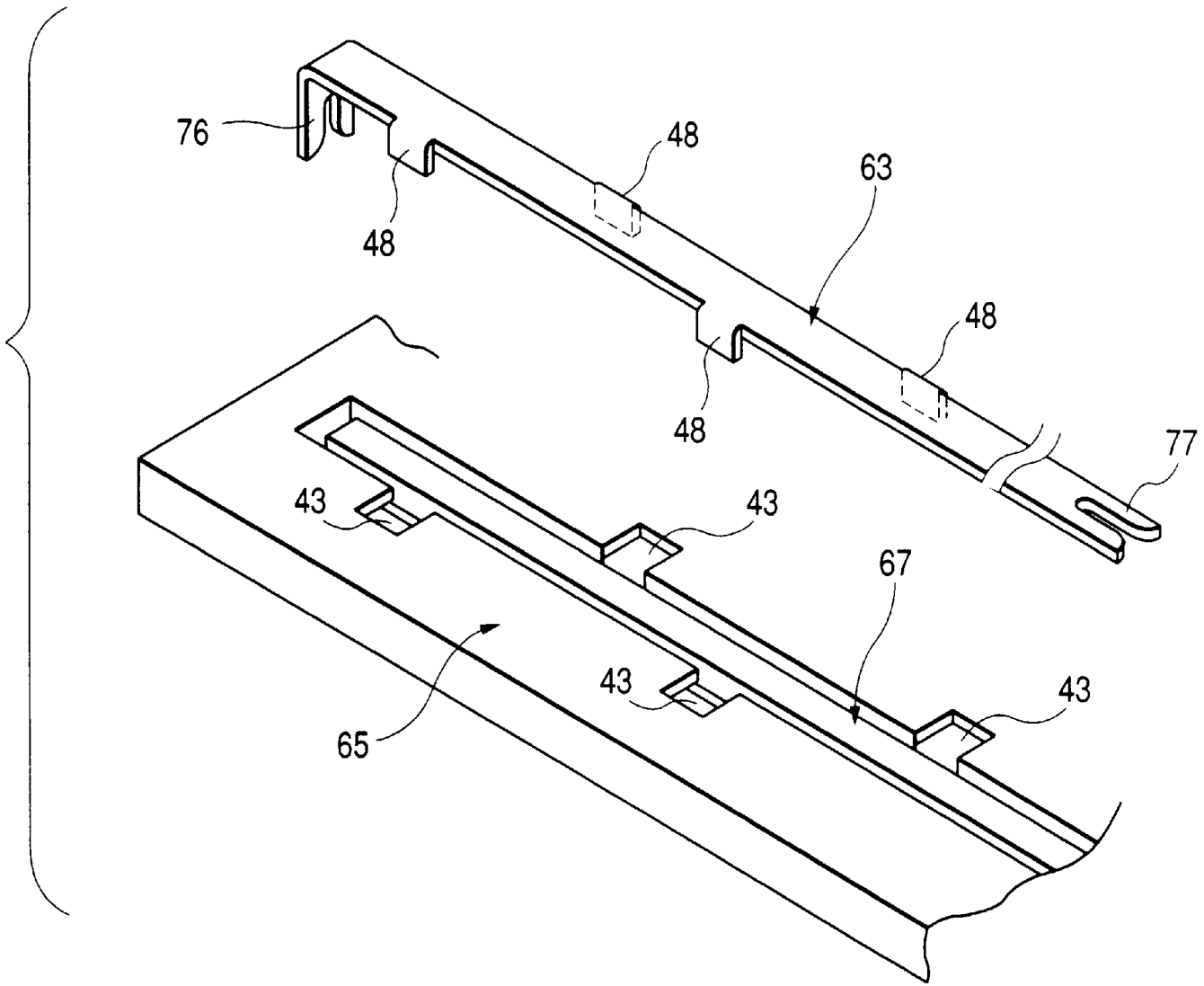
FIG. 13 is an enlarged perspective view showing an important portion of a third embodiment of an interlayer connection structure of the invention.
Figure 14:
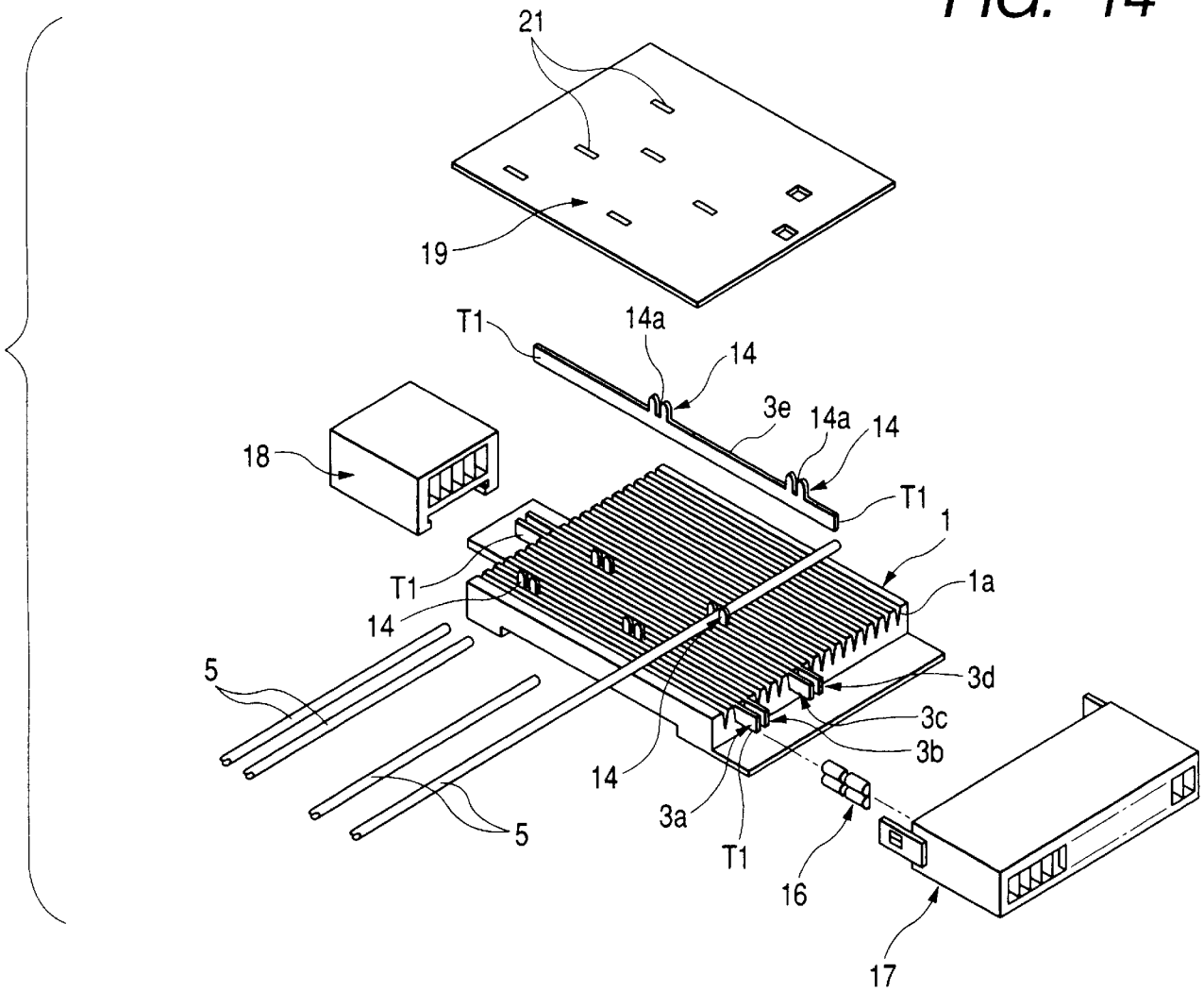
FIG. 14 is an exploded, perspective view showing the construction of a conventional interlayer connection structure.

Next, a third embodiment of an interlayer connection structure of the invention will be described with reference to FIG. 13.

An insulative bus bar board 65, used in the interlayer connection structure of this third embodiment, includes a plurality of rows of bus bar mounting portions 67 (each in the form of a recess) each for receiving a bus bar 63 in a fitted manner, and rows of terminal holding openings 43 which are formed respectively in the opposed longitudinal side edges of each of the bus bar mounting portions 67 in staggered relation to each other.

A press-connecting terminal portion 76 and a tuning fork terminal portion 77 are formed respectively at the opposite ends of the bus bar 63 as described above for the bus bar 33 of the above embodiments. Contact portions 48, which face press-connecting terminal members (not shown) mounted in the terminal holding openings 43, are formed on the opposite longitudinal side edges of the bus bar 63 in a staggered manner, and are arranged at the same pitch as that of the terminal holding openings 43, the contact portions 48 being bent perpendicularly relative to the bus bar 63.

In the interlayer connection structure of this third embodiment, the interval between the adjacent terminal holding openings 43 can be reduced to a half of the interval of the adjacent terminal holding openings 43 in the first and second embodiments in which each row of terminal holding openings 43, formed in the bus bar board, are spaced at the predetermined intervals only along one longitudinal side edge of a respective one of the bus bars 33.

Namely, as described above, in the case where the press-connecting terminal members 35, having the predetermined width, are arranged at the predetermined intervals along one longitudinal side edge of the bus bar 33, the distance between the axes (centerlines) of the wires 39, press-connected to the press-connecting end blades 35*a* of the adjacent press-connecting terminal members 35, can not be made smaller than the predetermined width of the press-connecting terminal member 35.

On the other hand, in the interlayer connection structure of this third embodiment, the press-connecting terminal members are arranged at the opposite longitudinal side edges of the bus bar 63 in a staggered manner, and therefore the distance between the axes of the wires 39 can be made smaller than the predetermined width of the press-connecting terminal member without causing the adjacent press-connecting terminal members to interfere with each other. In FIG. 13, for better understanding of the arrangement of the terminal holding openings 43 and the contact portions 48, the interval between these openings 43, as well as the interval of these contact portions 48, is shown as being larger than actual.

Therefore, the pitch of the wires 39, forming a wire layer, can be reduced, and by doing so, the interlayer connection of a higher density can be achieved, and also an electric connection box, such as a branch box, having the interlayer connection, can be formed into a small size.

In each of the above embodiments, there are used the plurality of bus bars of a single kind having the same arrangement of the contact portions 48. However, what is needed here is to reduce the number of the kinds of bus bars used to form the bus bar layer, and two or more kinds of bus bars, having different arrangements of the contact portions 48, may be used.

The specific structure of the bus bar mounting portions, formed in the insulative bus bar board, and the specific structure of the contact portions, formed on the bus bar, are not limited to those in the above embodiments.

For example, in the above embodiment, although the discrete contact portions, formed by bending, are arranged at the predetermined intervals along the length of the bus bar, a continuous contact portion can be formed by bending a side edge portion of the bus bar generally over the entire length thereof.

The press-connecting terminal portion 46 and the tuning fork terminal portion 47, integrally formed respectively at the opposite ends of the bus bar, can be suitably modified in accordance with the actual use and the arrangement within the electric connection box.

The interlayer connection structure of the invention can be used not only in the wiring connection of an electric system of an automobile but also in various fields in which the branch•joint connection of the wiring is needed.

In the interlayer connection structures of the present invention, the positions of mounting of the press-connecting terminal members on each bus bar can be easily changed arbitrarily by selectively changing the terminal holding openings in which the press-connecting terminal members are to be mounted, respectively. Accordingly, a variety of bus bar layers, having different mounting positions of the press-connecting terminal members, can be provided even by the use of a single kind of bus bars.

Therefore, there can be obtained the interlayer connection structure in which a wide variety of branch•joint connections can be effected without increasing the kind of the bus bars 33 used to form the bus bar layer. By thus reducing the kind of the bus bars to be used, the production cost can be reduced.

Therefore, there can be provided the interlayer connection structure in which a wide variety of branch•joint connections can be achieved without increasing kinds of bus bars used to form the bus bar layer.

What is claimed is:

1. An interlayer connection structure comprising:

an insulative bus bar board having a plurality of rows of terminal holding openings which are spaced at predetermined intervals along a longitudinal side edge;

a plurality of bus bars of an electrically-conductive material juxtaposed on said insulative bus bar board;

press-connecting terminal members mounted respectively in predetermined terminal holding openings to be electrically connected respectively to the corresponding bus bars; and a plurality of wires press-connected by the press-connecting end blades of said predetermined press-connecting terminal members extending through said terminal holding openings;

wherein a branch-joint connection between a bus bar layer, formed by the plurality of bus bars, and a wire layer, formed by the plurality of wires, is effected through said press-connecting terminal members.

2. An interlayer connection structure according to claim 1, further comprising:

a wire-holding insulative board having a plurality of wire-mounting grooves for juxtaposing said wires, and press-connecting blade relief holes for enabling said press-connecting end blades to be press-connected to said wires juxtaposed on said wire-holding insulative board;

wherein said wire-holding insulative board is overlapped with said insulative bus bar board.

3. An interlayer connection structure according to claim 1, wherein said insulative bus bar board has a plurality of wire-mounting grooves on the reverse surface of said insulative bus bar board, and said plurality of wire-mounting grooves can support said wires in a fixed manner, respectively;

wherein a plurality of wire-mounting grooves for juxtaposing said wires are formed on the reverse surface of said insulative bus bar board.

4. An interlayer connection structure according to claim 1, wherein contact portions facing said press-connecting terminal members are formed by bending respectively on those portions of at least one longitudinal side edge of said bus bar corresponding respectively to said terminal holding openings, and wherein each of said press-connecting terminal members has a resilient contact piece portion for press-contact with said contact portion.

5. An interlayer connection structure according to claim 1, wherein said terminal holding openings are formed in a staggered manner along the opposite longitudinal side edges of each of said bus bars.

* * * * *